US009335647B2

(12) United States Patent
Noguchi et al.

(10) Patent No.: US 9,335,647 B2
(45) Date of Patent: May 10, 2016

(54) ELECTROSTATIC CHARGE IMAGE DEVELOPING TONER, ELECTROSTATIC CHARGE IMAGE DEVELOPER, TONER CARTRIDGE, AND PROCESS CARTRIDGE

(71) Applicant: FUJI XEROX CO., LTD., Tokyo (JP)

(72) Inventors: Daisuke Noguchi, Kanagawa (JP); Masaru Takahashi, Kanagawa (JP); Atsushi Sugitate, Kanagawa (JP); Shuji Sato, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/476,163

(22) Filed: Sep. 3, 2014

(65) Prior Publication Data

US 2015/0192872 A1 Jul. 9, 2015

(30) Foreign Application Priority Data

Jan. 9, 2014 (JP) ..... 2014-002643

(51) Int. Cl.

| | |
|---|---|
| ***G03G 9/09*** | (2006.01) |
| ***G03G 9/087*** | (2006.01) |
| ***G03G 9/08*** | (2006.01) |
| ***G03G 9/097*** | (2006.01) |

(52) U.S. Cl.

CPC ..... *G03G 9/0902* (2013.01); *G03G 9/0819* (2013.01); *G03G 9/0825* (2013.01); *G03G 9/0827* (2013.01); *G03G 9/08711* (2013.01); *G03G 9/08728* (2013.01); *G03G 9/08755* (2013.01); *G03G 9/09733* (2013.01)

(58) Field of Classification Search

CPC ..... G03G 9/08755; G03G 9/0825; G03G 9/0902; G03G 9/09733

USPC ..... 430/108.1, 110.1

See application file for complete search history.

(56) References Cited

U.S. PATENT DOCUMENTS

| | | | | |
|---|---|---|---|---|
| 6,074,795 | A * | 6/2000 | Watanabe | G03G 9/081 430/108.4 |
| 6,403,272 | B1 * | 6/2002 | Kamada | H05K 3/102 430/108.1 |
| 2005/0214666 | A1 * | 9/2005 | Schulze-Hagenest | C09C 1/62 430/108.2 |
| 2009/0111040 | A1 * | 4/2009 | Veregin | G03G 9/08755 430/108.3 |
| 2011/0229815 | A1 * | 9/2011 | Kubo | G03G 9/0819 430/108.3 |
| 2013/0295351 | A1 * | 11/2013 | Tyagi | G03G 13/20 428/207 |
| 2013/0323633 | A1 * | 12/2013 | Takahashi | G03G 9/0902 430/105 |

FOREIGN PATENT DOCUMENTS

| | | | |
|---|---|---|---|
| JP | 2006091373 A | * | 4/2006 |
| JP | A-2013-057906 | | 3/2013 |

OTHER PUBLICATIONS

English language machine translation of JP 2006-091373 (Apr. 2006).*

* cited by examiner

*Primary Examiner* — Christopher D Rodee
(74) *Attorney, Agent, or Firm* — Oliff PLC

(57) ABSTRACT

An electrostatic charge image developing toner includes toner particles containing a binder resin containing a polyester resin, a particle of at least one selected from a styrene-(meth)acrylic resin particle and an acrylic resin particle, and a brilliant pigment.

11 Claims, 3 Drawing Sheets

ELECTROSTATIC CHARGE IMAGE DEVELOPING TONER, ELECTROSTATIC CHARGE IMAGE DEVELOPER, TONER CARTRIDGE, AND PROCESS CARTRIDGE

CROSS-REFERENCE TO RELATED APPLICATIONS

This application is based on and claims priority under 35 USC 119 from Japanese Patent Application No. 2014-002643 filed Jan. 9, 2014.

BACKGROUND

1. Technical Field

The present invention relates to an electrostatic charge image developing toner, an electrostatic charge image developer, a toner cartridge, and a process cartridge.

2. Related Art

Brilliant toner is used for forming an image having metallic gloss.

SUMMARY

According to an aspect of the invention, there is provided an electrostatic charge image developing toner having toner particles containing a binder resin containing a polyester resin;

a particle of at least one selected from a styrene-(meth) acrylic resin particle and an acrylic resin particle; and a brilliant pigment.

BRIEF DESCRIPTION OF THE DRAWINGS

Exemplary embodiments of the present invention will be described in detail based on the following figures, wherein.

DETAILED DESCRIPTION

Figure 1:
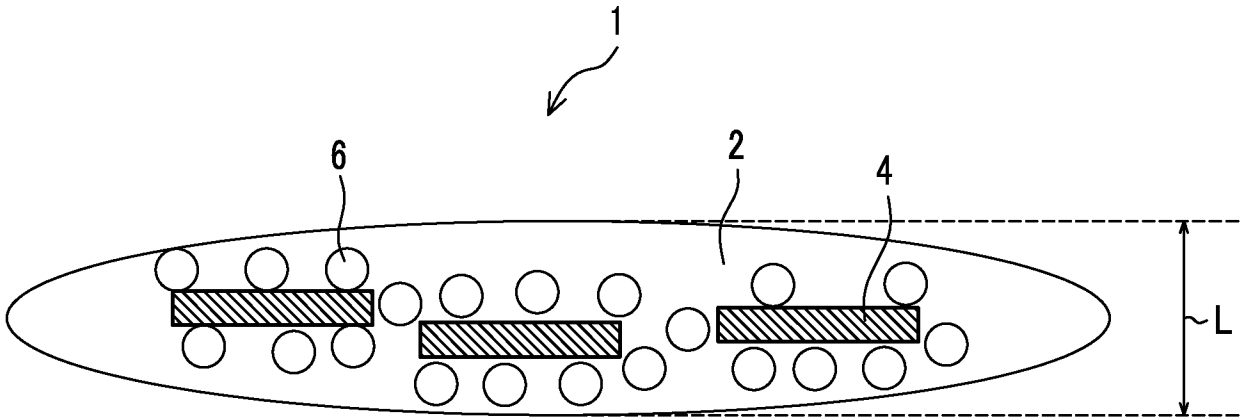
FIG. 1 is a schematic cross-sectional view showing an example of electrostatic charge image developing toner according to an exemplary embodiment.

Hereinafter, exemplary embodiments of the invention will be described. The descriptions and examples are for describing the invention, and do not limit the scope of the invention.

In the present specification, (meth)acryl means acryl and methacryl, (meth)acrylic acid means acrylic acid and methacrylic acid, and (meth)acrylo means acrylo and methacrylo.

Electrostatic Charge Image Developing Toner

The electrostatic charge image developing toner according to the exemplary embodiment (also referred to as "toner") includes toner particles and may further include an external additive. That is, in the exemplary embodiment, the toner particles may be set as toner, or the external additive may be externally added to the toner particles to obtain toner.

The toner particles contained in the toner according to the exemplary embodiment contain a polyester resin, a brilliant pigment, and at least any one of styrene-acrylic resin particle and acrylic resin particle. At least any one of the styrene-acrylic resin particle and the acrylic resin particle is internally added to the toner particle according to the exemplary embodiment. With the toner containing the toner particles having such a configuration, occurrence of fogging may be prevented when forming an image. The "fogging" is a phenomenon that an unintended image appears in an image-formed surface of a recording medium.

In the related art, since most brilliant pigments have a flake shape, when a mechanical load is applied to the toner particle containing the brilliant pigment, the brilliant pigment tends to be exposed to the surface of the toner particle. Particularly, when a mechanical load (for example, repeated stirring in a developing device) is applied thereto for a long time in the environment of a high temperature and high humidity (for example, a temperature of 30° C. or higher/humidity of 80% RH or higher), the exposure of the brilliant pigment easily occurs. As a result, when the brilliant pigment is exposed to the surface of the toner particle, a charged quantity of the surface of the toner particle decreases or a charging polarity is inverted due to the conductive property of the brilliant pigment. Accordingly, the toner may be attached to an area on an image holding member with no electrostatic charge image, and thus fogging may occur.

In response to the phenomenon described above, in the toner according to the exemplary embodiment, since the toner particle contains at least any one of the styrene-acrylic resin particle and the acrylic resin particle, it is possible to cause the brilliant pigment to be hardly exposed to the surface of the toner particle and to prevent occurrence of fogging when forming an image. Since at least any one of the styrene-acrylic resin particle and the acrylic resin particle is contained in a state with a low interaction between the brilliant pigment and the polyester resin, an effect of increasing the interaction is obtained with the resin particle interposed therebetween, and therefore the mechanism described above is achieved. The effect of the exemplary embodiment is particularly obtained when a mechanical load is applied to the toner for a long time in the environment with a high temperature and high humidity.

Hereinafter, the configuration of the toner according to the exemplary embodiment will be described in detail.

Toner Particles

The toner particles contain the polyester resin, the brilliant pigment, and at least any one of the styrene-(meth)acrylic resin particle and the acrylic resin particle, and may further contain a release agent or other internal additives.

Polyester Resin

The toner particles contain the polyester resin as the binder resin. As the polyester resin, an amorphous polyester resin and a crystalline polyester resin may be used in combination.

Examples of the polyester resin include polycondensates of polyvalent carboxylic acids and polyols. A commercially available product or a synthesized product may be used as the polyester resin.

Examples of the polyvalent carboxylic acid include aliphatic dicarboxylic acids (e.g., oxalic acid, malonic acid, maleic acid, fumaric acid, citraconic acid, itaconic acid, glutaconic acid, succinic acid, alkenyl succinic acid, adipic acid, and sebacic acid), alicyclic dicarboxylic acids (e.g., cyclohexanedicarboxylic acid), aromatic dicarboxylic acids (e.g., terephthalic acid, isophthalic acid, phthalic acid, and naphthalenedicarboxylic acid), anhydrides thereof, or lower alkyl esters (having, for example, from 1 to 5 carbon atoms) thereof. Among these, for example, aromatic dicarboxylic acids are preferably used as the polyvalent carboxylic acid.

As the polyvalent carboxylic acid, a tri- or higher-valent carboxylic acid employing a crosslinked structure or a branched structure may be used in combination together with a dicarboxylic acid. Examples of the tri- or higher-valent carboxylic acid include trimellitic acid, pyromellitic acid, anhydrides thereof, or lower alkyl esters (having, for example, from 1 to 5 carbon atoms) thereof.

The polyvalent carboxylic acids may be used alone or in combination of two or more kinds thereof.

Examples of the polyol include aliphatic diols (e.g., ethylene glycol, diethylene glycol, triethylene glycol, propylene glycol, butanediol, hexanediol, and neopentyl glycol), alicyclic diols (e.g., cyclohexanediol, cyclohexanedimethanol, and hydrogenated bisphenol A), and aromatic diols (e.g., ethylene oxide adduct of bisphenol A and propylene oxide adduct of bisphenol A). Among these, for example, aromatic diols and alicyclic diols are preferably used, and aromatic diols are more preferably used as the polyol.

As the polyol, a tri- or higher-valent alcohol employing a crosslinked structure or a branched structure may be used in combination together with diol. Examples of the tri- or higher-valent alcohol include glycerin, trimethylolpropane, and pentaerythritol.

The polyols may be used alone or in combination of two or more kinds thereof.

The glass transition temperature (Tg) of the polyester resin is preferably from 50° C. to 80° C., and more preferably from 50° C. to 65° C.

The glass transition temperature is acquired by a DSC curve obtained by differential scanning calorimetry (DSC). More specifically, the glass transition temperature is acquired by "extrapolation glass transition starting temperature" disclosed in a method of acquiring the glass transition temperature of JIS K7121-1987 "Testing Methods for Transition Temperature of Plastics".

A weight-average molecular weight (Mw) of the polyester resin is preferably from 5,000 to 1,000,000, and more preferably from 7,000 to 500,000.

A number-average molecular weight (Mn) of the polyester resin is preferably from 2,000 to 100,000.

Molecular weight distribution Mw/Mn of the polyester resin is preferably from 1.5 to 100, and more preferably from 2 to 60.

The weight-average molecular weight and the number-average molecular weight of the resin are measured by gel permeation chromatography (GPC). The molecular weight measurement by GPC is performed with a tetrahydrofuran solvent using HLC-8120 manufactured by Tosoh Corporation as a measurement device by using TSKgel Super HM-M (15 cm) manufactured by Tosoh Corporation as a column. The weight-average molecular weight and the number-average molecular weight are calculated using a calibration curve of molecular weight created with a monodisperse polystyrene standard sample from results of this measurement.

A content of the polyester resin of the toner particles is, for example, preferably from 40% by weight to 85% by weight, more preferably from 50% by weight to 75% by weight, and even more preferably from 60% by weight to 70% by weight.

Other Binder Resin

The toner particles may contain other binder resins, in addition to the polyester resin. Examples of the other binder resins include an epoxy resin, a polyurethane resin, a polyamide resin, a cellulose resin, a polyether resin, polystyrene, a styrene-alkyl (meth)acrylate copolymer, a styrene-(meth) acrylonitrile copolymer, a styrene-butadiene copolymer, and a styrene-maleic anhydride copolymer. The resins may be used alone or in combination of two or more kinds thereof.

Styrene-(Meth)Acrylic Resin Particle and Acrylic Resin Particle

Hereinafter, at least one of the styrene-(meth)acrylic resin particle and the acrylic resin particle will be described by collectively referring to these as a specific resin particle.

In the toner particles, it is preferable that the specific resin particle be dispersed in the binder resin, and it is more preferable that a so-called sea-island structure in which the binder resin is set as a sea portion and the specific resin particle is set as an island portion be formed. The specific resin particle is preferably unevenly distributed around the brilliant pigment, in order to further prevent the exposure of the brilliant pigment.

The resin configuring the styrene-(meth)acrylic resin particle is not particularly limited as long as it is a copolymer of styrene and (meth)acrylic acid ester, and (meth)acrylic acid is also preferably contained in a polymerization component. The resin described above may contain a polymerization component other than styrene, (meth)acrylic acid ester, and (meth)acrylic acid, but a weight ratio thereof is preferably smaller than 10% by weight.

The resin configuring the acrylic resin particle is not particularly limited as long as it is a polymer of (meth)acrylic acid ester, and (meth)acrylic acid is also preferably contained in a polymerization component. The resin described above may contain a polymerization component other than (meth) acrylic acid ester and (meth)acrylic acid, but a weight ratio thereof is preferably smaller than 10% by weight.

In the exemplary embodiment, the two kinds of the resins are set as the styrene-acrylic resin as long as 5% by weight or more of styrene is contained as the polymerization component.

The resin configuring the specific resin particle preferably contains (meth)acrylic acid as a polymerization component. When (meth)acrylic acid is contained as a polymerization component, a polarity of the specific resin particle increases, an interaction between the specific resin particle and the brilliant pigment generally having a oxidized surface increases, and thus the exposure of the brilliant pigment may be further prevented. The content of (meth)acrylic acid is preferably equal to or greater than 0.1% by weight, more preferably equal to or greater than 0.2% by weight, and even more preferably equal to or greater than 0.3% by weight, as the polymerization component in the resin. An upper limit of the content of (meth)acrylic acid is not particularly limited, but the upper limit thereof is preferably equal to or smaller than 10% by weight and more preferably equal to or smaller than 5% by weight, in order to secure the content of styrene and acrylic acid ester.

As the polymerization component of the resin configuring the specific resin particle, β-carboxyethylacrylate, crotonic acid, maleic acid, fumaric acid, and the like may be preferably used, in addition to (meth)acrylic acid.

Examples of (meth)acrylic acid ester as the polymerization component of the resin configuring the specific resin particle preferably include alkyl (meth)acrylate including an alkyl group having 1 to 18 carbon atoms such as methyl (meth) acrylate, ethyl (meth)acrylate, n-butyl (meth)acrylate, isobutyl (meth)acrylate, tert-butyl (meth)acrylate, glycidyl (meth) acrylate, cyclohexyl (meth)acrylate, 2-ethylhexyl (meth) acrylate, lauryl (meth)acrylate, and stearyl (meth)acrylate.

A weight-average molecular weight (Mw) of the resin configuring the specific resin particle is, for example, preferably from 5,000 to 1,000,000 and more preferably from 7,000 to 500,000.

A number-average particle diameter of the specific resin particles is preferably from 30 nm to 300 nm. When the number-average particle diameter of the specific resin particles is equal to or greater than 30 nm, the exposure of the brilliant pigment is further prevented and accordingly the occurrence of fogging is even further prevented. When the number-average particle diameter of the specific resin particles is equal to or smaller than 300 nm, the specific resin particle and the binder resin are excellently adhered to each other, and accordingly the exposure of the brilliant pigment is further prevented and therefore, the occurrence of fogging is even further prevented. In addition, when the number-average particle diameter of the specific resin particles is from 30 nm to 300 nm, an image having a more excellent brilliance is obtained.

From this viewpoint, the number-average particle diameter of the specific resin particles is preferably from 50 nm to 200 nm and more preferably from 70 nm to 120 nm.

The number-average particle diameter of the specific resin particle in the toner particles is measured with the following method, for example. First, the toner particles are embedded by using a bisphenol A type liquid epoxy resin and a curing agent, and a sample for cutting is prepared. Then, the sample for cutting is cut at a temperature of −100° C. by using a cutting machine including a diamond knife, for example, LEICA Ultramicrotome (manufactured by Hitachi High-Technologies Corporation), and a sample for observation is prepared. The sample for observation is observed with a magnification of approximately 10,000 with a transmission electron microscope (TEM). On the imaged microscope image, the specific resin particles are specified depending on a shape and intensity of contrast. 100 specific resin particles are arbitrarily selected, and a maximum diameter and a minimum diameter of each particle are measured by image analysis. An intermediate value of two diameters is set as a sphere-equivalent diameter, and a median diameter (particle diameter with a cumulative percentage of 50%) of the sphere-equivalent diameters based on the number thereof is set as a number-average particle diameter.

The total amount (content) of the specific resin particles occupying the toner particles is preferably from 3% by weight to 32% by weight. When the total amount of the specific resin particles is equal to or greater than 3% by weight, the exposure of the brilliant pigment is further prevented and accordingly the occurrence of fogging is even further prevented. When the total amount of the specific resin particles is equal to or smaller than 32% by weight, an excellent fixability of the toner is obtained, and as a result, an image having a more excellent brilliance is obtained, and also the exposure of the brilliant pigment to the surface of the toner particles may be prevented due to the interaction between the polyester resin and the specific resin particle.

From the viewpoint described above, the total amount of the specific resin particle occupying the toner particles is more preferably from 4% by weight to 20% by weight and even more preferably from 5% by weight to 15% by weight.

Brilliant Pigment

Examples of the brilliant pigment include metal powder such as aluminum, brass, bronze, nickel, stainless steel, or zinc; mica on which titanium oxide or yellow iron oxide is coated; a flake-shape crystal or a plate-shape crystal such as aluminosilicate, basic carbonate, barium sulfate, titanium oxide, or bismuth oxychloride; laminar glass powder; laminar glass powder which is subjected to metal vapor deposition; and the like. Among these, the metal powder is preferably used from a viewpoint of mirror reflection intensity, and the metal powder having a flake shape is more preferably used from a viewpoint of higher mirror reflection intensity. Among the metal powder, aluminum powder is preferably used, from a viewpoint of availability of the flake-shaped powder. The surface of the metal powder may be coated with silica, an acrylic resin, or a polyester resin.

The content of the brilliant pigment with respect to the toner particles is, for example, preferably from 1% by weight to 50% by weight, more preferably from 5% by weight to 30% by weight, and even more preferably from 10% by weight to 20% by weight.

Further, a weight ratio of the specific resin particle and the brilliant pigment is preferably in a range of 3:1 to 3:50.

Release Agent

Examples of the release agent include hydrocarbon waxes; natural waxes such as carnauba wax, rice wax, and candelilla wax; synthetic or mineral/petroleum waxes such as montan wax; and ester waxes such as fatty acid esters and montanic acid esters. The release agent is not limited thereto.

The melting temperature of the release agent is preferably from 50° C. to 110° C., and more preferably from 60° C. to 100° C.

The melting temperature of the release agent is obtained from "melting peak temperature" described in the method of obtaining a melting temperature in JIS K7121-1987 "Testing methods for transition temperatures of plastics", from a DSC curve obtained by differential scanning calorimetry (DSC).

The content of the release agent with respect to the toner particles is preferably from 1% by weight to 20% by weight, and more preferably from 5% by weight to 15% by weight.

Other Additives

Examples of other additives include known additives such as a magnetic material, a charge-controlling agent, and an inorganic powder. The toner particles include these additives as internal additives.

Characteristics of Toner Particles

The toner particles may be toner particles having a single-layer structure, or toner particles having a so-called core/shell structure composed of a core (core particle) and a coating layer (shell layer) coated on the core.

For example, the toner particle is a toner particle in which the specific resin particle and the brilliant pigment are dispersed in the binder resin, and is preferably a toner particle which has a so-called sea-island structure in which the polyester resin is set as a sea portion and the specific resin particle is set as an island portion and in which the brilliant pigment is contained in this sea-island structure. In this case, in the sea-island structure described above, the island portion is preferably disposed unevenly around the brilliant pigment, in order to further prevent the exposure of the brilliant pigment.

FIG. 1 shows an outline of the preferable embodiment. As shown in FIG. 1, a toner particle 1 preferably has a so-called sea-island structure in which a polyester resin 2 is set as a sea portion and specific resin particles 6 are set as island portions, brilliant pigments 4 are preferably contained in this sea-island structure, and the specific resin particles 6 as the island portions are preferably disposed unevenly around the brilliant pigments 4.

The toner particle preferably includes a coating layer containing a polyester resin, and a core containing a polyester resin, a brilliant pigment, and a specific resin particle, in order to further prevent the exposure of the brilliant pigment.

In addition, the toner particle preferably includes a coating layer containing a polyester resin, and a core having a sea-island structure in which the polyester resin is set as a sea portion and the specific resin particles are set as island portions, in which the brilliant pigments are contained in this sea-island structure. In this case, in the sea-island structure described above, the island portion is preferably disposed unevenly around the brilliant pigment, in order to further prevent the exposure of the brilliant pigment. That is, the core described above is preferably a core having a sea-island structure in which the polyester resin is set as a sea portion and the specific resin particles are set as island portions, in which the brilliant pigments are contained in this sea-island structure, and the island portions are unevenly disposed around the brilliant pigments.

A volume average particle diameter (D50v) of the toner particles is preferably from 1 μm to 30 μm and more preferably from 5 μm to 20 μm.

Various average particle diameters and various particle size distribution indices of the toner particles are measured using a Coulter Multisizer II (manufactured by Beckman Coulter, Inc.) and ISOTON-II (manufactured by Beckman Coulter, Inc.) as an electrolyte.

In the measurement, from 0.5 mg to 50 mg of a measurement sample is added to 2 ml of a 5% aqueous solution of surfactant (preferably sodium alkylbenzene sulfonate) as a dispersing agent. The obtained material is added to 100 ml to 150 ml of the electrolyte.

The electrolyte in which the sample is suspended is subjected to a dispersion treatment using an ultrasonic disperser for 1 minute, and a particle size distribution of particles having a particle diameter of 2 μm to 60 μm is measured by a Coulter Multisizer II using an aperture having an aperture diameter of 100 μm. 50,000 particles are sampled.

Cumulative distributions by volume and by number are drawn from the side of the smallest diameter with respect to particle size ranges (channels) separated based on the measured particle size distribution. The particle diameter when the cumulative percentage becomes 16% is defined as that corresponding to a volume particle diameter D16v and a number particle diameter D16p, while the particle diameter when the cumulative percentage becomes 50% is defined as that corresponding to a volume average particle diameter D50v and a number-average particle diameter D50p. Furthermore, the particle diameter when the cumulative percentage becomes 84% is defined as that corresponding to a volume particle diameter D84v and a number particle diameter D84p.

Using these, a volume average particle size distribution index (GSDv) is calculated as $(D84v/D16v)^{1/2}$, while a number-average particle size distribution index (GSDp) is calculated as $(D84p/D16p)^{1/2}$.

A shape factor SF1 of the toner particles is preferably from 110 to 150, and more preferably from 120 to 140.

The shape factor SF1 is obtained through the following expression.

$$SF1=(ML^2/A)\times(\pi/4)\times 100 \quad \text{Expression:}$$

In the foregoing expression, ML represents an absolute maximum length of a toner particle, and A represents a projected area of a toner particle.

Specifically, the shape factor SF1 is numerically converted mainly by analyzing a microscopic image or a scanning electron microscopic image by the use of an image analyzer, and is calculated as follows. That is, an optical microscopic image of particles scattered on a surface of a glass slide is input to an image analyzer Luzex through a video camera to obtain maximum lengths and projected areas of 100 particles, values of SF1 are calculated through the foregoing expression, and an average value thereof is obtained.

The toner particles are preferably flake shape. The particles of the brilliant toner preferably have an average equivalent circle diameter D larger than an average maximum thickness C.

A toner particle 2 shown in FIG. 1 is a flake shape toner particle having an equivalent circle diameter larger than a thickness L, and contains flake shape brilliant pigment particles 4, and spherical shape particles 6 selected from styrene-(meth)acrylic resin particles and acrylic resin particles.

External Additive

Examples of the external additive include inorganic particles. Examples of the inorganic particles include $SiO_2$, $TiO_2$, $Al_2O_3$, CuO, ZnO, $SnO_2$, $CeO_2$, $Fe_2O_3$, MgO, BaO, CaO, $K_2O$, $Na_2O$, $ZrO_2$, $CaO.SiO_2$, $K_2O.(TiO_2)_n$, $Al_2O_3.2SiO_2$, $CaCO_3$, $MgCO_3$, $BaSO_4$, and $MgSO_4$.

Surfaces of the inorganic particles as an external additive are preferably subjected to a hydrophobizing treatment. The hydrophobizing treatment is performed by, for example, dipping the inorganic particles in a hydrophobizing agent. The hydrophobizing agent is not particularly limited and examples thereof include a silane coupling agent, silicone oil, a titanate coupling agent, and an aluminum coupling agent. These may be used alone or in combination of two or more kinds thereof.

The amount of the hydrophobizing agent is, for example, from 1 part by weight to 10 parts by weight with respect to 100 parts by weight of the inorganic particles.

Examples of the external additive also include resin particles (resin particles such as polystyrene, PMMA, and melamine resin particles) and a cleaning aid (e.g., metal salt of higher fatty acid represented by zinc stearate, and fluorine polymer particles).

The amount of the external additive externally added is, for example, preferably from 0.01% by weight to 5% by weight, and more preferably from 0.01% by weight to 2% by weight with respect to the toner particles.

Toner Preparing Method

For the toner according to the exemplary embodiment, after preparing the toner particles, the toner particles may be set as toner, or the external additive may be externally added to the toner particles to obtain toner.

The toner particles may be prepared using any of a dry method (e.g., kneading and pulverizing method) and a wet method (e.g., aggregation and coalescence method, suspension and polymerization method, and dissolution and suspension method). The method is not particularly limited thereto, and a known method is employed.

The toner particles are preferably prepared with an aggregation and coalescence method. Since the styrene-acrylic resin and the acrylic resin have a higher hydrophobic property than the polyester resin, when granulation is performed in an aqueous medium with the aggregation and coalescence method, the styrene-acrylic resin particle or the acrylic resin is first aggregated with the brilliant pigment, and then the polyester resin particle is aggregated on the outside of the aggregate. Since, in the toner particles prepared as described above, the specific resin particles are disposed unevenly around the brilliant pigment and the polyester resin exists around the specific resin particle, the brilliant pigment is hardly exposed from the surface of the toner particles.

Specifically, when the toner particles are prepared by an aggregation and coalescence method, the toner particles are prepared at least through the processes below.

- A step of preparing a first resin particle dispersion in which polyester resin particles (first resin particles) are dispersed (first resin particle dispersion preparing step)
- A step of preparing a second resin particle dispersion in which at least any of styrene-acrylic resin particles and acrylic resin particles (second resin particles) are dispersed (second resin particle dispersion preparing step)
- A step of preparing a pigment dispersion in which brilliant pigments are dispersed (pigment dispersion preparing step)
- A step of aggregating a resin particle and a pigment particle in the dispersion obtained by mixing the first resin particle dispersion, the second resin particle dispersion, and the pigment dispersion and forming an aggregated particle (aggregated particle forming step)

A step of heating the aggregated particle dispersion in which the aggregated particle is dispersed, performing coalescence of the aggregated particle, and forming the toner particle (coalescence step)

Hereinafter, each step will be described in detail.

Resin Particle Dispersion Preparing Step

The first resin particle dispersion in which the polyester resin particles (first resin particles) as the binder resins are dispersed, and the second resin particle dispersion in which at least any of styrene-acrylic resin particles and acrylic resin particles (second resin particles) are dispersed, are prepared. Hereinafter, both of the first resin particle dispersion and the second resin particle dispersion will be described by collectively referring these as a resin particle dispersion.

The resin particle dispersion is prepared by dispersing the resin particles in a dispersion medium by a surfactant, for example.

An aqueous medium is used, for example, as the dispersion medium used in the resin particle dispersion.

Examples of the aqueous mediums include water such as distilled water and ion exchange water, and alcohols. These may be used alone or in combination of two or more kinds thereof.

Examples of the surfactant include anionic surfactants such as sulfuric ester salt, sulfonate, phosphate, and soap; cationic surfactants such as amine salt and quaternary ammonium salt; and nonionic surfactants such as polyethylene glycol, alkyl phenol ethylene oxide adduct, and polyol. Among these, anionic surfactants and cationic surfactants are particularly preferably used. Nonionic surfactants may be used in combination with anionic surfactants or cationic surfactants.

The surfactants may be used alone or in combination of two or more kinds thereof.

Regarding the resin particle dispersion, as a method of dispersing the resin particles in the dispersion medium, a common dispersing method using, for example, a rotary shearing-type homogenizer, or a ball mill, a sand mill, or a Dyno mill having media is exemplified. Depending on the kind of the resin particles, resin particles may be dispersed in the resin particle dispersion using, for example, a phase inversion emulsification method.

The phase inversion emulsification method includes: dissolving a resin to be dispersed in a hydrophobic organic solvent in which the resin is soluble; conducting neutralization by adding a base to an organic continuous phase (O phase); and converting the resin (so-called phase inversion) from W/O to O/W by putting an aqueous medium (W phase) to form a discontinuous phase, thereby dispersing the resin as particles in the aqueous medium.

The volume average particle diameter of the resin particles dispersed in the resin particle dispersion is, for example, preferably from 0.01 μm to 1 μm, more preferably from 0.08 μm to 0.8 μm, and even more preferably from 0.1 μm to 0.6 μm.

Regarding the volume average particle diameter of the resin particles, a cumulative distribution by volume is drawn from the side of the smallest diameter with respect to particle size ranges (channels) separated using the particle size distribution obtained by the measurement of a laser diffraction-type particle size distribution measuring device (for example, LA-700 manufactured by Horiba, Ltd.), and a particle diameter when the cumulative percentage becomes 50% with respect to the entire particles is measured as a volume average particle diameter D50v. The volume average particle diameter of the particles in other dispersion is also measured in the same manner.

The content of the resin particles contained in the resin particle dispersion is preferably from 5% by weight to 50% by weight, and more preferably from 10% by weight to 40% by weight.

Pigment Dispersion Preparing Step

The pigment dispersion in which brilliant pigments are dispersed is prepared in the pigment dispersion preparing step.

The pigment dispersion is prepared by dispersing the brilliant pigments in a dispersion medium by a surfactant, for example. An aqueous medium is used, for example, as the dispersion medium of the pigment dispersion. Examples of the aqueous mediums include water such as distilled water and ion exchange water; alcohols; and a mixture thereof.

Examples of the surfactant include anionic surfactants such as sulfuric ester salt, sulfonate, phosphate, and soap; cationic surfactants such as amine salt and quaternary ammonium salt; and nonionic surfactants such as polyethylene glycol, alkyl phenol ethylene oxide adduct, and polyol. The surfactants may be used alone or in combination of two or more kinds thereof.

As a method of dispersing the brilliant pigments in the dispersion medium, a common dispersing method using, for example, a rotary shearing-type homogenizer, or a ball mill, a sand mill, or a Dyno mill having media is exemplified.

The volume average particle diameter of the particles and the particle content of the pigment dispersion are the same as those of the resin particle dispersion.

In a case of containing the release agent in the toner particle, a release agent dispersion in which release agent particles are dispersed is prepared in a release agent dispersion preparing step. The release agent dispersion is prepared with the same method as the preparing method of the pigment dispersion. That is, the dispersion medium, the surfactant, the dispersion method, the volume average particle diameter of the particles, and the particle content of the release agent dispersion are the same as those of the pigment dispersion.

Aggregated Particle Forming Process

Next, the first resin particle dispersion, the second resin particle dispersion, and the pigment dispersion are mixed with each other. Herein, the release agent dispersion may also be mixed therewith. The resin particles and the pigment particles are heterogeneously aggregated in the mixed dispersion, thereby forming aggregated particles having a diameter near a target toner particle diameter and including the resin particles and the pigment particles. At that time, when performing the aggregated particle forming step in the aqueous medium, since the styrene-acrylic resin and the acrylic resin entirely have a higher hydrophobic property as a resin than the polyester resin, the second resin particles are aggregated around the brilliant pigment, and then the first resin particles are aggregated around that, and accordingly the aggregated particles are formed.

Specifically, for example, an aggregating agent is added to the mixed dispersion and a pH of the mixed dispersion is adjusted to be acidic (for example, the pH is from 2 to 5). If necessary, a dispersion stabilizer is added. Then, the mixed dispersion is heated at a temperature close to the glass transition temperature of the resin particles (specifically, for example, from a temperature 30° C. lower than the glass transition temperature of the resin particles to a temperature 10° C. lower than the glass transition temperature of the resin particle) to aggregate the particles dispersed in the mixed dispersion, thereby forming the aggregated particles.

In the aggregated particle forming process, for example, the aggregating agent may be added at room temperature (for example, 25° C.) under stirring of the mixed dispersion using a rotary shearing-type homogenizer, the pH of the mixed dispersion may be adjusted to be acidic (for example, the pH is from 2 to 5), a dispersion stabilizer may be added if necessary, and the heating may then be performed.

Examples of the aggregating agent include a surfactant having an opposite polarity to the polarity of the surfactant contained in the mixed dispersion, such as inorganic metal salts and di- or higher-valent metal complexes. When a metal complex is used as the aggregating agent, the amount of the aggregating agent is reduced and charging characteristics are improved.

An additive may be used which forms a complex or a similar bond with the metal ions of the aggregating agent, with the aggregating agent. A chelating agent is preferably used as the additive.

Examples of the inorganic metal salts include metal salts such as calcium chloride, calcium nitrate, barium chloride, magnesium chloride, zinc chloride, aluminum chloride, and aluminum sulfate; and inorganic metal salt polymers such as polyaluminum chloride, polyaluminum hydroxide, and calcium polysulfide.

A water-soluble chelating agent may be used as the chelating agent. Examples of the chelating agent include oxycarboxylic acids such as tartaric acid, citric acid, and gluconic acid; and aminocarboxylic acid such as iminodiacetic acid (IDA), nitrilotriacetic acid (NTA), and ethylenediaminetetraacetic acid (EDTA).

The amount of the chelating agent added is, for example, preferably from 0.01 part by weight to 5.0 parts by weight, and more preferably from 0.1 part by weight to less than 3.0 parts by weight with respect to 100 parts by weight of the resin particles.

Coalescence Process

Next, the aggregated particle dispersion in which the aggregated particles are dispersed is heated at, for example, a temperature that is equal to or higher than the glass transition temperature of the polyester resin (for example, a temperature that is higher than the glass transition temperature of the polyester resin by 10° C. to 30° C.) to coalesce the aggregated particles and form toner particles.

Toner particles are obtained through the foregoing processes.

After the aggregated particle dispersion in which the aggregated particles are dispersed is obtained, toner particles may be prepared through the processes of: further mixing the aggregated particle dispersion, and the first resin particle dispersion in which the polyester resin particles as the binder resins are dispersed, to conduct aggregation so that the polyester resin particles further adhere to the surfaces of the aggregated particles, thereby forming second aggregated particles; and coalescing the second aggregated particles by heating the second aggregated particle dispersion in which the second aggregated particles are dispersed, thereby forming toner particles having a core/shell structure.

After the coalescence process ends, the toner particles formed in the solution are subjected to a washing process, a solid-liquid separation process, and a drying process, that are well known, and thus dry toner particles are obtained.

In the washing process, preferably, displacement washing using ion exchange water is sufficiently performed from the viewpoint of charging properties. In addition, the solid-liquid separation process is not particularly limited, but suction filtration, pressure filtration, or the like is preferably performed from the viewpoint of productivity. The method for the drying process is also not particularly limited, but freeze drying, flash jet drying, fluidized drying, vibration-type fluidized drying, or the like is preferably performed from the viewpoint of productivity.

The toner according to this exemplary embodiment is prepared by, for example, adding and mixing an external additive with dry toner particles. The mixing is preferably performed with, for example, a V-blender, a Henschel mixer, a Lödige mixer, or the like. Furthermore, if necessary, coarse toner particles may be removed using a vibration sieving machine, a wind classifier, or the like.

Electrostatic Charge Image Developer

An electrostatic charge image developer according to this exemplary embodiment includes at least the toner according to this exemplary embodiment. The electrostatic charge image developer according to this exemplary embodiment may be a single-component developer including only the toner according to this exemplary embodiment, or a two-component developer obtained by mixing the toner with a carrier.

The carrier is not particularly limited, and known carriers are exemplified. Examples of the carrier include a coated carrier in which surfaces of cores formed of a magnetic powder are coated with a resin; a magnetic powder dispersion-type carrier in which a magnetic powder is dispersed and blended in a matrix resin; and a resin impregnation-type carrier in which a porous magnetic powder is impregnated with a resin. The magnetic powder dispersion-type carrier and the resin impregnation-type carrier may be carriers in which constituent particles of the carrier are used as a core and a surface of the core is coated with a resin.

Examples of the magnetic powder include magnetic metals such as iron, nickel, and cobalt; and magnetic oxides such as ferrite and magnetite.

Examples of the coating resin and the matrix resin include polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylic acid copolymer, a straight silicone resin configured to include an organosiloxane bond or a modified product thereof, a fluororesin, polyester, polycarbonate, a phenol resin, and an epoxy resin. The coating resin and the matrix resin may contain additives such as a conductive material. Examples of the conductive materials include particles of metals such as gold, silver, and copper; carbon black particles, titanium oxide particles, zinc oxide particles, tin oxide particles, barium sulfate particles, aluminum borate particles, and potassium titanate particles.

A coating method using a coating layer forming solution in which a coating resin, and various additives (used if necessary) are dissolved in an appropriate solvent is used to coat the surface of a core with the resin. The solvent is not particularly limited, and may be selected in consideration of the type of resin to be used, coating suitability, and the like. Specific examples of the resin coating method include a dipping method of dipping cores in a coating layer forming solution; a spraying method of spraying a coating layer forming solution to surfaces of cores; a fluid bed method of spraying a coating layer forming solution in a state in which cores are allowed to float by flowing air; and a kneader-coater method in which cores of a carrier and a coating layer forming solution are mixed with each other in a kneader-coater and then the solvent is removed.

The mixing ratio (weight ratio) between the toner and the carrier in the two-component developer is preferably from 1:100 to 30:100, and more preferably from 3:100 to 20:100 (toner:carrier).

Image Forming Apparatus/Image Forming Method

An image forming apparatus and an image forming method according to this exemplary embodiment will be described.

The image forming apparatus according to this exemplary embodiment is provided with an image holding member, a charging unit that charges a surface of the image holding member, an electrostatic charge image forming unit that forms an electrostatic charge image on a charged surface of the image holding member, a developing unit that contains an electrostatic charge image developer and develops the electrostatic charge image formed on the surface of the image holding member with the electrostatic charge image developer to form a toner image, a transfer unit that transfers the toner image formed on the surface of the image holding member onto a surface of a recording medium, and a fixing unit that fixes the toner image transferred onto the surface of the recording medium. As the electrostatic charge image developer, the electrostatic charge image developer according to this exemplary embodiment is applied.

In the image forming apparatus according to this exemplary embodiment, an image forming method (image forming method according to this exemplary embodiment) including a charging process of charging a surface of an image holding member, an electrostatic charge image forming process of forming an electrostatic charge image on the charged surface of the image holding member, a developing process of developing the electrostatic charge image formed on the surface of the image holding member with the electrostatic charge image developer according to this exemplary embodiment to form a toner image, a transfer process of transferring the toner image formed on the surface of the image holding member onto a surface of a recording medium, and a fixing process of fixing the toner image transferred onto the surface of the recording medium is performed.

As the image forming apparatus according to this exemplary embodiment, a known image forming apparatus is applied, such as a direct transfer-type apparatus that directly transfers a toner image formed on a surface of an image holding member onto a recording medium; an intermediate transfer-type apparatus that primarily transfers a toner image formed on a surface of an image holding member onto a surface of an intermediate transfer member, and secondarily transfers the toner image transferred onto the surface of the intermediate transfer member onto a surface of a recording medium; an apparatus that is provided with a cleaning unit that cleans a surface of an image holding member after transfer of a toner image and before charging; or an apparatus that is provided with an erasing unit that irradiates, after transfer of a toner image and before charging, a surface of an image holding member with erasing light for erasing.

In the case where the image forming apparatus according to the exemplary embodiment is an intermediate transfer-type apparatus, a transfer unit has, for example, an intermediate transfer member having a surface onto which a toner image is to be transferred, a primary transfer unit that primarily transfers a toner image formed on a surface of an image holding member onto the surface of the intermediate transfer member, and a secondary transfer unit that secondarily transfers the toner image transferred onto the surface of the intermediate transfer member onto a surface of a recording medium.

In the image forming apparatus according to this exemplary embodiment, for example, a part including the developing unit may have a cartridge structure (process cartridge) that is detachable from the image forming apparatus. As the process cartridge, for example, a process cartridge that accommodates the electrostatic charge image developer according to this exemplary embodiment and is provided with a developing unit is preferably used.

Hereinafter, an example of the image forming apparatus according to this exemplary embodiment will be described. However, this image forming apparatus is not limited thereto. In the description hereinafter, major parts shown in the drawing will be described, but descriptions of other parts will be omitted. In the description hereinafter, an example of a case where the toner according to this exemplary embodiment is silver toner will be described, but there is no limitation thereto.

Figure 2:
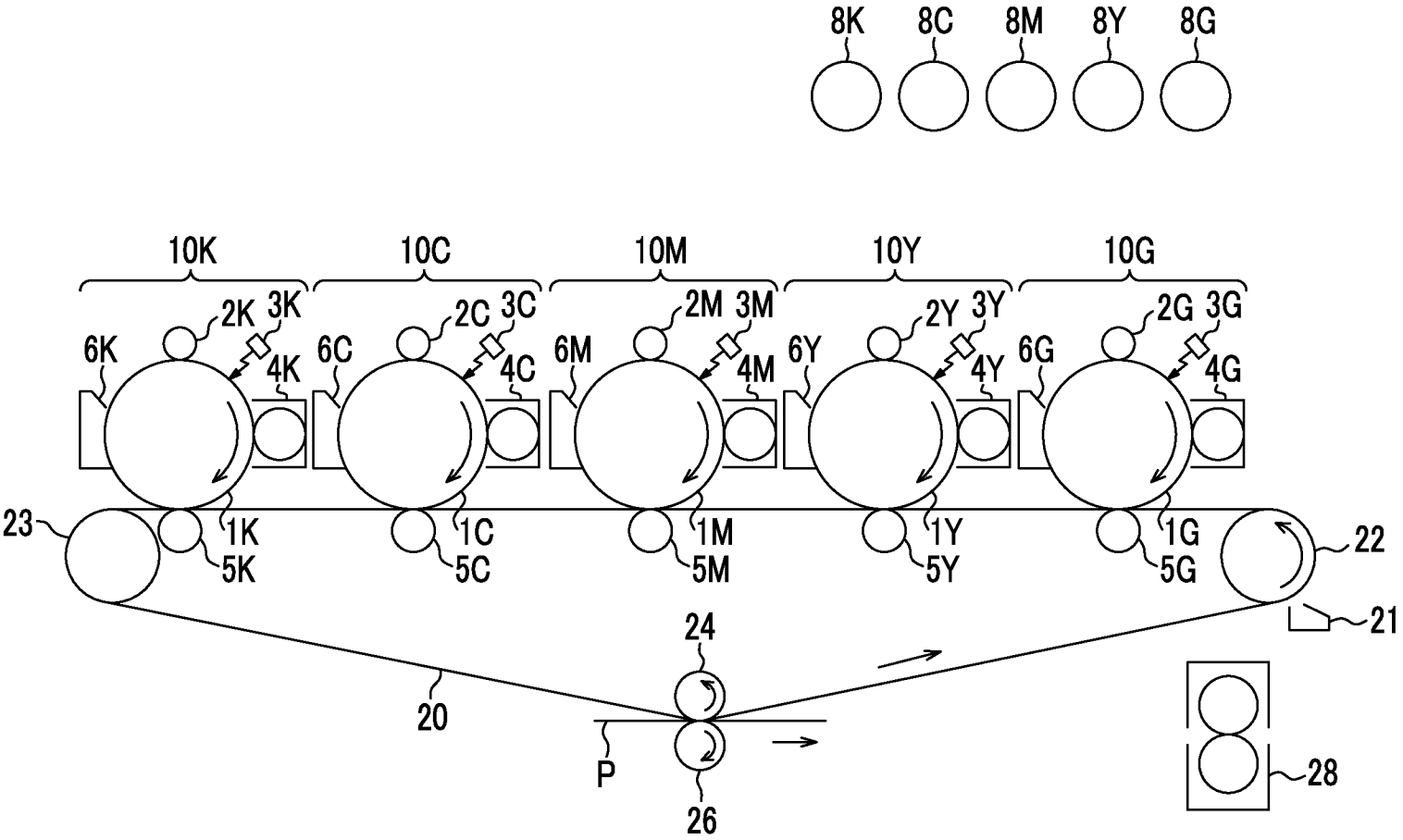
FIG. 2 is a schematic configuration diagram showing an example of an image forming apparatus of the exemplary embodiment.

FIG. 2 is a schematic configuration diagram showing the image forming apparatus according to this exemplary embodiment, and is a diagram showing an image forming apparatus which is a quintuple tandem type and an intermediate transfer type.

The image forming apparatus shown in FIG. 2 is provided with first to fifth electrophotographic image forming units 10G, 10Y, 10M, 10C, and 10K (image forming units) that output silver (G), yellow (Y), magenta (M), cyan (C), and black (K) images based on color-separated image data, respectively. These image forming units (hereinafter, may be simply referred to as "units") 10G, 10Y, 10M, 10C, and 10K are arranged side by side at predetermined intervals in a horizontal direction. These units 10G, 10Y, 10M, 10C, and 10K may be process cartridges that are detachable from the image forming apparatus.

An intermediate transfer belt 20 (an example of the intermediate transfer member) is installed below the units 10G, 10Y, 10M, 10C, and 10K to extend through the units. The intermediate transfer belt 20 is wound on a driving roll 22, a support roll 23, and an opposite roll 24 contacting the inner surface of the intermediate transfer belt 20, and travels in a direction toward the fifth unit 10K from the first unit 10G. In addition, an intermediate transfer member cleaning device 21 opposed to the driving roll 22 is provided on a surface of the intermediate transfer belt 20 on the image holding member side.

Developing devices (an example of the developing units) 4G, 4Y, 4M, 4C, and 4K of the units 10G, 10Y, 10M, 10C, and 10K are supplied with toner including a silver toner, a yellow toner, a magenta toner, a cyan toner, and a black toner accommodated in toner cartridges 8G, 8Y, 8M, 8C, and 8K, respectively.

The first to fifth units 10G, 10Y, 10M, 10C, and 10K have the same configuration, operation, and effect, and accordingly, only the first unit 10G that is disposed on the upstream side of the intermediate transfer belt in a traveling direction to form a silver image will be representatively described herein.

The first unit 10G has a photoreceptor 1G acting as an image holding member. Around the photoreceptor 1G, a charging roll (an example of the charging unit) 2G that charges a surface of the photoreceptor 1G to a predetermined potential, an exposure device (an example of the electrostatic charge image forming unit) 3G that exposes the charged surface with laser beams based on a color-separated image signal to form an electrostatic charge image, a developing device (an example of the developing unit) 4G that supplies the toner to the electrostatic charge image to develop the electrostatic charge image, a primary transfer roll (an example of the primary transfer unit) 5G that transfers the developed toner image onto the intermediate transfer belt 20, and a photoreceptor cleaning device (an example of the cleaning unit) 6G that removes the toner remaining on the surface of the photoreceptor 1G after primary transfer, are arranged in sequence.

The primary transfer roll 5G is disposed inside the intermediate transfer belt 20 to be provided at a position opposed to the photoreceptor 1G. Furthermore, bias supplies (not shown) that apply a primary transfer bias are connected to the primary transfer rolls 5G, 5Y, 5M, 5C, and 5K of each unit, respectively. Each bias supply changes a value of a transfer bias that is applied to each primary transfer roll under the control of a controller (not shown).

Hereinafter, an operation of forming a silver image in the first unit 10G will be described.

First, before the operation, the surface of the photoreceptor 1G is charged to a potential of from −600 V to −800 V by the charging roll 2G.

The photoreceptor 1G is formed by laminating a photosensitive layer on a conductive (for example, volume resistivity at 20° C.: $1\times10^{-6}$ Ωcm or less) substrate. The photosensitive layer typically has high resistance (that is the same as the resistance of a general resin), but has properties in which when laser beams are applied, the specific resistance of a part irradiated with the laser beams changes. Accordingly, the laser beams are emitted to the charged surface of the photoreceptor 1G from the exposure device 3G in accordance with image data for silver sent from the controller (not shown). Therefore, an electrostatic charge image of a silver image pattern is formed on the surface of the photoreceptor 1G.

The electrostatic charge image is an image that is formed on the surface of the photoreceptor 1G by charging, and is a so-called negative latent image, that is formed by applying laser beams from the exposure device 3G so that the specific resistance of the irradiated part of the photosensitive layer is lowered to cause charges to flow on the surface of the photoreceptor 1G, while charges stay on a part to which the laser beams are not applied.

The electrostatic charge image formed on the photoreceptor 1G is rotated up to a predetermined developing position with the travelling of the photoreceptor 1G. The electrostatic charge image on the photoreceptor 1G is developed and visualized as a toner image at the developing position by the developing device 4G.

The developing device 4G accommodates, for example, an electrostatic charge image developer including at least the toner according to the exemplary embodiment and the carrier. The toner according to the exemplary embodiment is frictionally charged by being stirred in the developing device 4G to have a charge with the same polarity (negative polarity) as the charge that is on the photoreceptor 1G, and is thus held on the developer roll (an example of the developer holding member). By allowing the surface of the photoreceptor 1G to pass through the developing device 4G, the toner according to the exemplary embodiment electrostatically adheres to the latent image part having been erased on the surface of the photoreceptor 1G, whereby the latent image is developed with the toner. Next, the photoreceptor 1G having the silver toner image formed thereon continuously travels at a predetermined rate and the toner image developed on the photoreceptor 1G is transported to a predetermined primary transfer position.

When the silver toner image on the photoreceptor 1G is transported to the primary transfer position, a primary transfer bias is applied to the primary transfer roll 5G and an electrostatic force toward the primary transfer roll 5G from the photoreceptor 1G acts on the toner image, whereby the toner image on the photoreceptor 1G is transferred onto the intermediate transfer belt 20. The transfer bias applied at this time has the opposite polarity (+) to the toner polarity (−), and, for example, is controlled to +10 μA in the first unit 10G by the controller (not shown).

On the other hand, the toner remaining on the photoreceptor 1G is removed and collected by the photoreceptor cleaning device 6G.

The primary transfer biases that are applied to the primary transfer rolls 5Y, 5M, 5C, and 5K of the second unit 10Y and the subsequent units are also controlled in the same manner as in the case of the first unit.

In this manner, the intermediate transfer belt 20 onto which the silver toner image is transferred in the first unit 10G is sequentially transported through the second to fifth units 10Y, 10M, 10C, and 10K, and the toner images of respective colors are multilayer-transferred in a superimposed manner.

The intermediate transfer belt 20 onto which the five color toner images have been multiply-transferred through the first to fifth units reaches a secondary transfer part that is composed of the intermediate transfer belt 20, the opposite roll 24 contacting the inner surface of the intermediate transfer belt, and a secondary transfer roll (an example of the secondary transfer unit) 26 disposed on the image holding surface side of the intermediate transfer belt 20. Meanwhile, a recording sheet (an example of the recording medium) P is supplied to a gap between the secondary transfer roll 26 and the intermediate transfer belt 20, that are brought into contact with each other, via a supply mechanism at a predetermined timing, and a secondary transfer bias is applied to the opposite roll 24. The transfer bias applied at this time has the same polarity (−) as the toner polarity (−), and an electrostatic force toward the recording sheet P from the intermediate transfer belt 20 acts on the toner image, whereby the toner image on the intermediate transfer belt 20 is transferred onto the recording sheet P. In this case, the secondary transfer bias is determined depending on the resistance detected by a resistance detector (not shown) that detects the resistance of the secondary transfer part, and is voltage-controlled.

Thereafter, the recording sheet P is fed to a pressure-contacting part (nip part) between a pair of fixing rolls in a fixing device (an example of the fixing unit) 28 so that the toner image is fixed to the recording sheet P, whereby a fixed image is formed.

Examples of the recording sheet P onto which a toner image is transferred include plain paper that is used in electrophotographic copiers, printers, and the like. As a recording medium, an OHP sheet is also exemplified other than the recording sheet P.

The surface of the recording sheet P is preferably smooth in order to further improve smoothness of the image surface after fixing. For example, coating paper obtained by coating a surface of plain paper with a resin or the like, art paper for printing, and the like are preferably used.

The recording sheet P on which the fixing of the color image is completed is discharged toward a discharge part, and a series of the color image forming operations end.

Process Cartridge/Toner Cartridge

A process cartridge according to this exemplary embodiment will be described.

The process cartridge according to this exemplary embodiment is provided with a developing unit that accommodates the electrostatic charge image developer according to this exemplary embodiment and develops an electrostatic charge image formed on a surface of an image holding member with the electrostatic charge image developer to form a toner image, and is detachable from an image forming apparatus.

The process cartridge according to this exemplary embodiment is not limited to the above-described configuration, and may be configured to include a developing device, and if necessary, at least one selected from other units such as an image holding member, a charging unit, an electrostatic charge image forming unit, and a transfer unit.

Hereinafter, an example of the process cartridge according to this exemplary embodiment will be shown. However, this process cartridge is not limited thereto. In the description hereinafter, major parts shown in the drawing will be described, but descriptions of other parts will be omitted.

Figure 3:
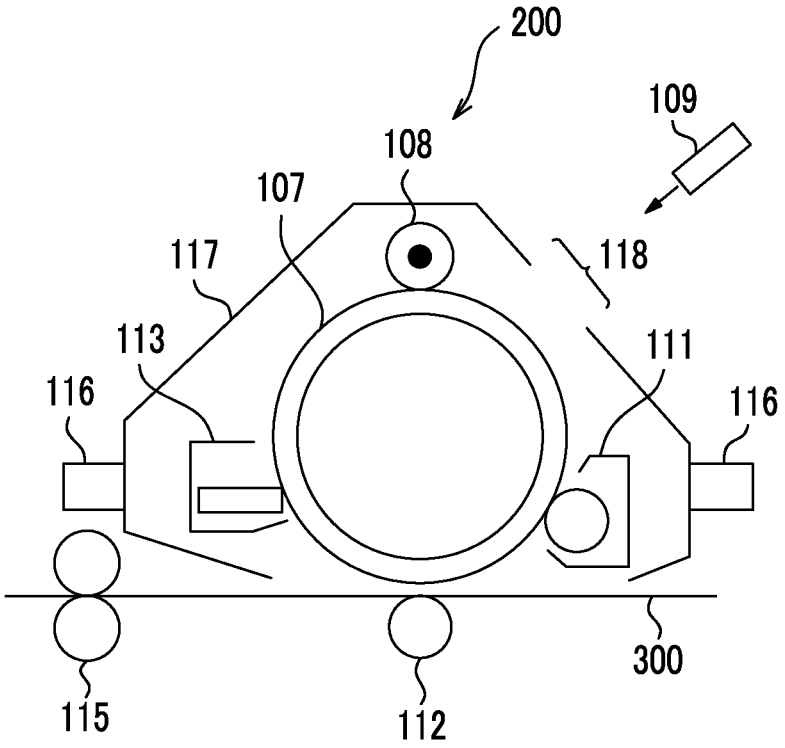
FIG. 3 is a schematic configuration diagram showing an example of a process cartridge of the exemplary embodiment.

FIG. 3 is a schematic diagram showing a configuration of the process cartridge according to this exemplary embodiment.

A process cartridge 200 shown in FIG. 3 is formed as a cartridge having a configuration in which a photoreceptor 107 (an example of the image holding member), a charging roll 108 (an example of the charging unit), a developing device 111 (an example of the developing unit), and a photoreceptor cleaning device 113 (an example of the cleaning unit), which are provided around the photoreceptor 107, are integrally combined and held by the use of, for example, a housing 117 provided with a mounting rail 116 and an opening 118 for exposure.

In FIG. 3, the reference numeral 109 represents an exposure device (an example of the electrostatic charge image forming unit), the reference numeral 112 represents a transfer device (an example of the transfer unit), the reference numeral 115 represents a fixing device (an example of the fixing unit), and the reference numeral 300 represents a recording sheet (an example of the recording medium).

Next, a toner cartridge according to this exemplary embodiment will be described.

The toner cartridge according to this exemplary embodiment accommodates the toner according to this exemplary embodiment and is detachable from an image forming apparatus. The toner cartridge accommodates a toner for replenishment for being supplied to the developing unit provided in the image forming apparatus.

The image forming apparatus shown in FIG. 2 has such a configuration that the toner cartridges 8G, 8Y, 8M, 8C, and 8K are detachable therefrom, and the developing devices 4G, 4Y, 4M, 4C, and 4K are connected to the toner cartridges corresponding to the respective colors via toner supply tubes (not shown), respectively. In addition, when the toner accommodated in the toner cartridge runs low, the toner cartridge is replaced.

EXAMPLES

Hereinafter, this exemplary embodiment will be described in detail using examples, but is not limited to these examples, within a range not departing from the scope of the invention.

In the following description, unless otherwise noted, "parts" and "%" are based on weight.

Synthesis of Polyester Resin

Bisphenol A ethylene oxide 2-mol adduct: 216 parts

Ethylene glycol: 32 parts

Propylene glycol: 6 parts

Tetrabutoxytitanate: 0.037 part

The above materials are put in two-necked flask which is dried by heating, nitrogen gas is introduced in a container to maintain an inert atmosphere, and the components are heated while stirring, and then are subjected to co-condensation polymerization reaction for 7 hours at 160° C., and then a temperature thereof is increased to 220° C. while slowly reducing pressure thereof to 10 Torr and those are maintained for 4 hours. The pressure is temporarily returned to normal pressure, 9 parts of trimellitic anhydride is added, and the pressure thereof is slowly reduced again to 10 Torr and maintained for 1 hours at 220° C., to synthesize the polyester resin.

Preparation of Binder Resin Particle Dispersion

Polyester resin obtained as described above: 160 parts

Ethyl acetate: 230 parts

Sodium hydroxide aqueous solution (0.3 N): 0.1 part

The above materials are put in a 1000 ml separable flask, heated at 70° C., and stirred with Three-One Motor (manufactured by Shinto Scientific Co., Ltd.) to prepare resin mixed liquid. The resin mixed liquid is further stirred, 373 parts of the ion exchange water is slowly added therein to perform phase inversion emulsification, and the solvent thereof is removed to obtain a binder resin particle dispersion (solid content concentration: 30%).

Preparation of Resin Particle Dispersion A

Styrene: 280 parts n-butyl acrylate: 120 parts

Acrylic acid: 2 parts

Dodecanethiol: 24 parts

The mixed solution of the above materials, 6 parts of a nonionic surfactant (NONIPOL 400 manufactured by Sanyo Chemical Industries, Ltd.), and 12 parts of an anionic surfactant (NEOGEN R manufactured by Dai-Ichi Kogyo Seiyaku Co., Ltd.) are dissolved in 550 parts of ion exchange water and mixed by stirring in a reaction vessel for 20 minutes, and 50 parts of ion exchange water in which 4 parts of ammonium persulfate is dissolved is put thereinto. Then, after performing nitrogen substitution in the reaction vessel, the resultant material is heated in the vessel to 70° C., and emulsion polymerization is continued for 5 hours. As a result, a resin particle dispersion A (solid content concentration of 30%) which has the volume average particle diameter D50v of 98 nm, which is measured with a laser diffraction-type particle diameter distribution measuring apparatus (LA-700 manufactured by HORIBA, Ltd.), is obtained.

Preparation of Resin Particle Dispersion B

A resin particle dispersion B having the volume average particle diameter D50v of 73 nm is obtained in the same manner as in the preparation of the resin particle dispersion A, except for changing the amount of the anionic surfactant from 12 parts to 15 parts.

Preparation of Resin Particle Dispersion C

A resin particle dispersion C having the volume average particle diameter D50v of 110 nm is obtained in the same manner as in the preparation of the resin particle dispersion A, except for changing the amount of the anionic surfactant from 12 parts to 11 parts.

Preparation of Resin Particle Dispersion D

A resin particle dispersion D having the volume average particle diameter D50v of 67 nm is obtained in the same manner as in the preparation of the resin particle dispersion A, except for changing the amount of the anionic surfactant from 12 parts to 16 parts and setting the temperature in the vessel to 71° C.

Preparation of Resin Particle Dispersion E

A resin particle dispersion E having the volume average particle diameter D50v of 125 nm is obtained in the same manner as in the preparation of the resin particle dispersion A, except for changing the amount of the anionic surfactant from 12 parts to 10 parts and setting the temperature in the vessel to 69° C.

Preparation of Resin Particle Dispersion F

A resin particle dispersion F having the volume average particle diameter D50v of 53 nm is obtained in the same manner as in the preparation of the resin particle dispersion A, except for changing the amount of the anionic surfactant from 12 parts to 19 parts and setting the temperature in the vessel to 71° C.

Preparation of Resin Particle Dispersion G

A resin particle dispersion G having the volume average particle diameter D50v of 184 nm is obtained in the same manner as in the preparation of the resin particle dispersion A, except for changing the amount of the anionic surfactant from 12 parts to 7.5 parts and setting the temperature in the vessel to 69° C.

Preparation of Resin Particle Dispersion H

A resin particle dispersion H having the volume average particle diameter D50v of 47 nm is obtained in the same manner as in the preparation of the resin particle dispersion A, except for changing the amount of the anionic surfactant from 12 parts to 21 parts and setting the temperature in the vessel to 72° C.

Preparation of Resin Particle Dispersion I

A resin particle dispersion I having the volume average particle diameter D50v of 210 nm is obtained in the same manner as in the preparation of the resin particle dispersion A, except for changing the amount of the anionic surfactant from 12 parts to 6.8 parts and setting the temperature in the vessel to 68° C.

Preparation of Resin Particle Dispersion J

A resin particle dispersion J having the volume average particle diameter D50v of 32 nm is obtained in the same manner as in the preparation of the resin particle dispersion A, except for changing the amount of the anionic surfactant from 12 parts to 28 parts and setting the temperature in the vessel to 72° C.

Preparation of Resin Particle Dispersion K

A resin particle dispersion K having the volume average particle diameter D50v of 285 nm is obtained in the same manner as in the preparation of the resin particle dispersion A, except for changing the amount of the anionic surfactant from 12 parts to 5.4 parts and setting the temperature in the vessel to 68° C.

Preparation of Resin Particle Dispersion L

A resin particle dispersion L having the volume average particle diameter D50v of 29 nm is obtained in the same manner as in the preparation of the resin particle dispersion A, except for changing the amount of the anionic surfactant from 12 parts to 30 parts and setting the temperature in the vessel to 73° C.

Preparation of Resin Particle Dispersion M

A resin particle dispersion M having the volume average particle diameter D50v of 315 nm is obtained in the same manner as in the preparation of the resin particle dispersion A, except for changing the amount of the anionic surfactant from 12 parts to 5 parts and setting the temperature in the vessel to 67° C.

Preparation of Resin Particle Dispersion N

A resin particle dispersion N having the volume average particle diameter D50v of 101 nm is obtained in the same manner as in the preparation of the resin particle dispersion A, except for changing styrene to methyl acrylate.

Preparation of Resin Particle Dispersion O

A resin particle dispersion O having the volume average particle diameter D50v of 110 nm is obtained in the same manner as in the preparation of the resin particle dispersion A, except for changing styrene to methyl methacrylate.

Preparation of Resin Particle Dispersion P

A resin particle dispersion P having the volume average particle diameter D50v of 100 nm is obtained in the same manner as in the preparation of the resin particle dispersion A, except for changing acrylic acid to methacrylic acid.

Preparation of Resin Particle Dispersion Q

A resin particle dispersion Q having the volume average particle diameter D50v of 105 nm is obtained in the same manner as in the preparation of the resin particle dispersion A, except for not adding acrylic acid.

Example 1

Preparation of Release Agent Dispersion

Carnauba wax (RC-160 manufactured by Toa Kasei Co., Ltd.): 50 parts

Anionic surfactant (NEOGEN RK manufactured by Dai-Ichi Kogyo Seiyaku Co., Ltd.): 1.0 part Ion exchange water: 200 parts The above materials are mixed with each other and heated to 95° C., dispersed using a homogenizer (ULTRA-TURRAX T50 manufactured by IKA Ltd.), and then are subject to dispersion treatment with Manton-Gaulin high pressure homogenizer (manufactured by Gaulin Co., Ltd.) for 6 hours, and release agent dispersion (solid content concentration of 20%) formed by dispersing the release agent particles is prepared.

Preparation of Brilliant Pigment Particle Dispersion

Aluminum pigment (2173EA manufactured by SHOWA ALUMINUM POWDER K.K): 100 parts

Anionic surfactant (NEOGEN R manufactured by Dai-Ichi Kogyo Seiyaku Co., Ltd.): 1.5 parts Ion exchange water: 400 parts After removing a solvent from the paste of the aluminum pigment, the above components are mixed and dispersed for 1 hour using an emulsifying disperser CAVITRON (CR1010 manufactured by Pacific Machinery & Engineering Co., Ltd.), and brilliant pigment particle dispersion (solid content concentration of 20%) formed by dispersing the brilliant pigment (aluminum pigment) is obtained.

Preparation of Brilliant Toner 1

Binder resin particle dispersion: 400 parts

Resin particle dispersion A: 100 parts

Release agent dispersion: 100 parts

Brilliant pigment dispersion: 200 parts

Nonionic surfactant (IGEPAL CA897): 1.40 parts

The above materials are put in a 2 L cylindrical stainless steel container, dispersed and mixed for 10 minutes while applying a shear force at 4000 rpm using a homogenizer ULTRA-TURRAX T50 (manufactured by IKA Ltd.)

Then, 1.75 parts of 10% nitric acid aqueous solution of polyaluminum chloride is slowly added dropwise as an aggregating agent, the resultant material is dispersed and mixed for 15 minutes by the homogenizer of which a rotating speed is set to 5000 rpm, to prepare an aggregated particle dispersion.

After that, the aggregated particle dispersion is put in a polymerization vessel including a stirring device using stirring blades of two paddles for forming a laminar flow and a thermometer, heating is started with a mantle heater after setting a stirring rotation speed to 500 rpm, and growth of aggregated particles is promoted at 54° C. At that time, pH of the raw material dispersion is controlled to be in a range of 2.2 to 3.5 with 0.3 N nitric acid and 1 N sodium hydroxide aqueous solution. The aggregated particle dispersion is maintained in the pH range described above for about 2 hours. At that time, the volume average particle diameter of the aggregated particles measured using Multisizer II (aperture diameter: 50 μm, manufactured by Beckman Coulter K.K) is 9.9 μm.

Next, 200 parts of the binder resin particle dispersion is added and the resin particles are attached to the surface of the aggregated particles. The temperature thereof is increased to 56° C., the aggregated particles are prepared while confirming a size and a form of the particle with an optical microscope and Multisizer II.

Then, after increasing pH to 8.0 for coalescing the aggregated particles, the temperature thereof is increased to 75° C. After confirming that the aggregated particles are coalesced with the optical microscope, pH thereof is decreased to 6.0 while maintaining the temperature at 75° C., the heating is stopped after 1 hour, and cooling is performed at a temperature falling rate of 1.0° C./min. Then, after performing sieving with a mesh size of 40 μm and repeating water washing, the resultant material is dried with a vacuum drying machine to obtain toner. The volume average particle diameter of the obtained toner is 12.3 μm.

1.5 parts of a hydrophobic silica particle (RY50 manufactured by Nippon Aerosil Co., Ltd.) and 1.0 part of hydrophobic titanium oxide (T805 manufactured by Nippon Aerosil Co., Ltd.) are mixed and blended with respect to 100 parts of the toner for 30 seconds at 10,000 rpm by using a sample mill. Next, the resultant material is sieved with a vibration sieving machine having a mesh size of 45 μm, and brilliant toner 1 is obtained. The number-average particle diameter of the resin particles in the toner particle is measured with the measurement method described above and is 98 nm.

Example 2

Preparation of Brilliant Toner 2

Brilliant toner 2 is obtained in the same manner as in the preparation of the brilliant toner 1 except for changing 100 parts of the resin particle dispersion A to 136.8 parts of the resin particle dispersion B, and changing the amount of the binder resin particle dispersion to 363.2 parts.

Example 3

Preparation of Brilliant Toner 3

Brilliant toner 3 is obtained in the same manner as in the preparation of the brilliant toner 1 except for changing 100 parts of the resin particle dispersion A to 133.2 parts of the resin particle dispersion B, and changing the amount of the binder resin particle dispersion to 366.8 parts.

Example 4

Preparation of Brilliant Toner 4

Brilliant toner 4 is obtained in the same manner as in the preparation of the brilliant toner 1 except for changing 100 parts of the resin particle dispersion A to 46.8 parts of the resin particle dispersion B, and changing the amount of the binder resin particle dispersion to 453.2 parts.

Example 5

Preparation of Brilliant Toner 5

Brilliant toner 5 is obtained in the same manner as in the preparation of the brilliant toner 1 except for changing 100 parts of the resin particle dispersion A to 43.2 parts of the resin particle dispersion B, and changing the amount of the binder resin particle dispersion to 456.8 parts.

Example 6

Preparation of Brilliant Toner 6

Brilliant toner 6 is obtained in the same manner as in the preparation of the brilliant toner 1 except for changing 100 parts of the resin particle dispersion A to 136.8 parts of the resin particle dispersion C, and changing the amount of the binder resin particle dispersion to 363.2 parts.

Example 7

Preparation of Brilliant Toner 7

Brilliant toner 7 is obtained in the same manner as in the preparation of the brilliant toner 1 except for changing 100 parts of the resin particle dispersion A to 133.2 parts of the resin particle dispersion C, and changing the amount of the binder resin particle dispersion to 366.8 parts.

Example 8

Preparation of Brilliant Toner 8

Brilliant toner 8 is obtained in the same manner as in the preparation of the brilliant toner 1 except for changing 100 parts of the resin particle dispersion A to 46.8 parts of the resin particle dispersion C, and changing the amount of the binder resin particle dispersion to 453.2 parts.

Example 9

Preparation of Brilliant Toner 9

Brilliant toner 9 is obtained in the same manner as in the preparation of the brilliant toner 1 except for changing 100 parts of the resin particle dispersion A to 43.2 parts of the resin particle dispersion C, and changing the amount of the binder resin particle dispersion to 456.8 parts.

Example 10

Preparation of Brilliant Toner 10

Brilliant toner 10 is obtained in the same manner as in the preparation of the brilliant toner 1 except for changing 100 parts of the resin particle dispersion A to 133.2 parts of the resin particle dispersion D, and changing the amount of the binder resin particle dispersion to 366.8 parts.

Example 11

Preparation of Brilliant Toner 11

Brilliant toner 11 is obtained in the same manner as in the preparation of the brilliant toner 1 except for changing 100 parts of the resin particle dispersion A to 46.8 parts of the resin particle dispersion D, and changing the amount of the binder resin particle dispersion to 453.2 parts.

Example 12

Preparation of Brilliant Toner 12

Brilliant toner 12 is obtained in the same manner as in the preparation of the brilliant toner 1 except for changing 100 parts of the resin particle dispersion A to 133.2 parts of the resin particle dispersion E, and changing the amount of the binder resin particle dispersion to 366.8 parts.

Example 13

Preparation of Brilliant Toner 13

Brilliant toner 13 is obtained in the same manner as in the preparation of the brilliant toner 1 except for changing 100 parts of the resin particle dispersion A to 46.8 parts of the resin particle dispersion E, and changing the amount of the binder resin particle dispersion to 453.2 parts.

Example 14

Preparation of Brilliant Toner 14

Brilliant toner 14 is obtained in the same manner as in the preparation of the brilliant toner 1 except for changing 100 parts of the resin particle dispersion A to 181.8 parts of the resin particle dispersion F, and changing the amount of the binder resin particle dispersion to 318.2 parts.

Example 15

Preparation of Brilliant Toner 15

Brilliant toner 15 is obtained in the same manner as in the preparation of the brilliant toner 1 except for changing 100 parts of the resin particle dispersion A to 178.2 parts of the resin particle dispersion F, and changing the amount of the binder resin particle dispersion to 321.8 parts.

Example 16

Preparation of Brilliant Toner 16

Brilliant toner 16 is obtained in the same manner as in the preparation of the brilliant toner 1 except for changing 100 parts of the resin particle dispersion A to 37.8 parts of the resin particle dispersion F, and changing the amount of the binder resin particle dispersion to 462.2 parts.

Example 17

Preparation of Brilliant Toner 17

Brilliant toner 17 is obtained in the same manner as in the preparation of the brilliant toner 1 except for changing 100 parts of the resin particle dispersion A to 34.2 parts of the resin particle dispersion F, and changing the amount of the binder resin particle dispersion to 465.8 parts.

Example 18

Preparation of Brilliant Toner 18

Brilliant toner 18 is obtained in the same manner as in the preparation of the brilliant toner 1 except for changing 100 parts of the resin particle dispersion A to 181.8 parts of the resin particle dispersion G, and changing the amount of the binder resin particle dispersion to 318.2 parts.

Example 19

Preparation of Brilliant Toner 19

Brilliant toner 19 is obtained in the same manner as in the preparation of the brilliant toner 1 except for changing 100 parts of the resin particle dispersion A to 178.2 parts of the resin particle dispersion G, and changing the amount of the binder resin particle dispersion to 321.8 parts.

Example 20

Preparation of Brilliant Toner 20

Brilliant toner 20 is obtained in the same manner as in the preparation of the brilliant toner 1 except for changing 100 parts of the resin particle dispersion A to 37.8 parts of the resin particle dispersion G, and changing the amount of the binder resin particle dispersion to 462.2 parts.

Example 21

Preparation of Brilliant Toner 21

Brilliant toner 21 is obtained in the same manner as in the preparation of the brilliant toner 1 except for changing 100 parts of the resin particle dispersion A to 34.2 parts of the resin particle dispersion G, and changing the amount of the binder resin particle dispersion to 465.8 parts.

Example 22

Preparation of Brilliant Toner 22

Brilliant toner 22 is obtained in the same manner as in the preparation of the brilliant toner 1 except for changing 100 parts of the resin particle dispersion A to 178.2 parts of the resin particle dispersion H, and changing the amount of the binder resin particle dispersion to 321.8 parts.

Example 23

Preparation of Brilliant Toner 23

Brilliant toner 23 is obtained in the same manner as in the preparation of the brilliant toner 1 except for changing 100 parts of the resin particle dispersion A to 37.8 parts of the resin particle dispersion H, and changing the amount of the binder resin particle dispersion to 462.2 parts.

Example 24

Preparation of Brilliant Toner 24

Brilliant toner 24 is obtained in the same manner as in the preparation of the brilliant toner 1 except for changing 100 parts of the resin particle dispersion A to 178.2 parts of the resin particle dispersion I, and changing the amount of the binder resin particle dispersion to 321.8 parts.

Example 25

Preparation of Brilliant Toner 25

Brilliant toner 25 is obtained in the same manner as in the preparation of the brilliant toner 1 except for changing 100 parts of the resin particle dispersion A to 37.8 parts of the resin particle dispersion I, and changing the amount of the binder resin particle dispersion to 462.2 parts.

Example 26

Preparation of Brilliant Toner 26

Brilliant toner 26 is obtained in the same manner as in the preparation of the brilliant toner 1 except for changing 100 parts of the resin particle dispersion A to 297 parts of the resin particle dispersion J, and changing the amount of the binder resin particle dispersion to 203 parts.

Example 27

Preparation of Brilliant Toner 27

Brilliant toner 27 is obtained in the same manner as in the preparation of the brilliant toner 1 except for changing 100 parts of the resin particle dispersion A to 279 parts of the resin particle dispersion J, and changing the amount of the binder resin particle dispersion to 221 parts.

Example 28

Preparation of Brilliant Toner 28

Brilliant toner 28 is obtained in the same manner as in the preparation of the brilliant toner 1 except for changing 100 parts of the resin particle dispersion A to 28.8 parts of the resin particle dispersion J, and changing the amount of the binder resin particle dispersion to 471.2 parts.

Example 29

Preparation of Brilliant Toner 29

Brilliant toner 29 is obtained in the same manner as in the preparation of the brilliant toner 1 except for changing 100 parts of the resin particle dispersion A to 25.2 parts of the resin particle dispersion J, and changing the amount of the binder resin particle dispersion to 474.8 parts.

Example 30

Preparation of Brilliant Toner 30

Brilliant toner 30 is obtained in the same manner as in the preparation of the brilliant toner 1 except for changing 100 parts of the resin particle dispersion A to 297 parts of the resin particle dispersion K, and changing the amount of the binder resin particle dispersion to 203 parts.

Example 31

Preparation of Brilliant Toner 31

Brilliant toner 31 is obtained in the same manner as in the preparation of the brilliant toner 1 except for changing 100 parts of the resin particle dispersion A to 279 parts of the resin particle dispersion K, and changing the amount of the binder resin particle dispersion to 221 parts.

Example 32

Preparation of Brilliant Toner 32

Brilliant toner 32 is obtained in the same manner as in the preparation of the brilliant toner 1 except for changing 100 parts of the resin particle dispersion A to 28.8 parts of the resin particle dispersion K, and changing the amount of the binder resin particle dispersion to 471.2 parts.

Example 33

Preparation of Brilliant Toner 33

Brilliant toner 33 is obtained in the same manner as in the preparation of the brilliant toner 1 except for changing 100 parts of the resin particle dispersion A to 25.2 parts of the resin particle dispersion K, and changing the amount of the binder resin particle dispersion to 474.8 parts.

Example 34

Preparation of Brilliant Toner 34

Brilliant toner 34 is obtained in the same manner as in the preparation of the brilliant toner 1 except for changing 100 parts of the resin particle dispersion A to 279 parts of the resin particle dispersion L, and changing the amount of the binder resin particle dispersion to 221 parts.

Example 35

Preparation of Brilliant Toner 35

Brilliant toner 35 is obtained in the same manner as in the preparation of the brilliant toner 1 except for changing 100 parts of the resin particle dispersion A to 28.8 parts of the resin particle dispersion L, and changing the amount of the binder resin particle dispersion to 471.2 parts.

Example 36

Preparation of Brilliant Toner 36

Brilliant toner 36 is obtained in the same manner as in the preparation of the brilliant toner 1 except for changing 100 parts of the resin particle dispersion A to 279 parts of the resin particle dispersion M, and changing the amount of the binder resin particle dispersion to 221 parts.

Example 37

Preparation of Brilliant Toner 37

Brilliant toner 37 is obtained in the same manner as in the preparation of the brilliant toner 1 except for changing 100 parts of the resin particle dispersion A to 28.8 parts of the resin particle dispersion M, and changing the amount of the binder resin particle dispersion to 471.2 parts.

Example 38

Preparation of Brilliant Toner 38

Brilliant toner 38 is obtained in the same manner as in the preparation of the brilliant toner 1 except for changing the resin particle dispersion A to the resin particle dispersion N.

Example 39

Preparation of Brilliant Toner 39

Brilliant toner 39 is obtained in the same manner as in the preparation of the brilliant toner 1 except for changing the resin particle dispersion A to the resin particle dispersion O.

Example 40

Preparation of Brilliant Toner 40

Brilliant toner 40 is obtained in the same manner as in the preparation of the brilliant toner 1 except for changing the resin particle dispersion A to the resin particle dispersion P.

Example 41

Preparation of Brilliant Toner 41

Brilliant toner 41 is obtained in the same manner as in the preparation of the brilliant toner 1 except for changing the resin particle dispersion A to the resin particle dispersion Q.

Comparative Example 1

Preparation of Brilliant Toner R1

Brilliant toner R1 is obtained in the same manner as in the preparation of the brilliant toner 1 except for changing the amount of the binder resin particle dispersion from 400 parts to 500 parts and not containing the resin particle dispersion A.

Preparation of Developer 100 parts of ferrite particles (manufactured by Powdertech Co., Ltd., average particle diameter of 50 μm) and 1.5 parts of methyl methacrylate resin (manufactured by Mitsubishi Rayon Co., Ltd., molecular weight of 95,000, a component ratio equal to or lower than 10,000 thereof is 5%) are put in a pressure kneader with 500 parts of toluene, and stirred and mixed at a room temperature for 15 minutes, heated to 70° C. while mixing under the reduced pressure, and toluene is distilled (evaporated to be removed). Then, the resultant material is cooled, and classified by using a sieving machine having a mesh size of 105 μm, and a resin-coated ferrite carrier is obtained.

The resin-coated ferrite carrier and any one of the brilliant toner 1 to 41 and R1 are mixed so as to have toner concentration of 7%, each developer is prepared for each brilliant toner, and is set as each developer in Examples 1 to 41 and Comparative Example 1.

Evaluation

Brilliance

In the environment of a temperature of 32° C. and humidity of 80% RH, each developer obtained in each example is supplied to a developing device of modified DocuCentre-III C7600 manufactured by Fuji Xerox Co., Ltd., 100 images having a printed area of 1.0% are output on a recording sheet (OK Topcoat+ paper manufactured by Oji Paper Co., Ltd.) at the fixing temperature of 190° C. and the fixing pressure of 4.0 kg/cm$^2$, and then a 10 cm×10 cm solid image having a toner applied amount of 4.5 g/cm$^2$ is output.

The brilliance of the obtained solid image is visually evaluated with light for color observation (natural daylight) based on JIS K 5600-4-3: 1999 "Testing methods for paints-Part 4: Visual characteristics of film—Section 3: Visual comparison of the color of paints". A particle sensation (effect of the brilliance with glossiness) and an optical effect (change in hue depending on angle) are observed, and the brilliance is evaluated based on the following determination criteria. Level 2 or higher is a level which may be practically used. The results thereof are shown in Table 1.

Determination Criteria

5: The particle sensation and the optical effect are obtained and both effects are harmonized.

4: The particle sensation and the optical effect are obtained and both effects are slightly harmonized.

3: The particle sensation and the optical effect are obtained.

2: The particle sensation and the optical effect are obtained, but blurring is observed.

1: No particle sensation and the optical effect are obtained.

Fogging

With the evaluation machine and developers used in the evaluation of the brilliance, 10,000 images are output with the printed area of 3%, and then kept for 24 hours. After that, 10 sheets of 10 cm×10 cm solid images are output, and evaluation of fogging is performed. Levels AA to C are levels which may be practically used. The results thereof are shown in Table 1.

Determination Criteria

AA: Fogging is observed on neither of the image and photoreceptor.

A: Fogging is observed on the photoreceptor, but is not observed on the image.

B: Fogging is observed on the image through a magnifier.

C: Fogging is slightly visually observed on the image.

D: Fogging is significantly observed on the image.

TABLE 1

| | Type of resin particle dispersion | Content of specific resin particles in toner particle [% by weight] | Number-average particle diameter of specific resin particles in toner particle [nm] | Evaluation | |
|---|---|---|---|---|---|
| | | | | Brilliance | Fogging |
| Example 1 | A | 11 | 98 | 5 | AA |
| Example 2 | B | 15.2 | 73 | 4 | A |
| Example 3 | B | 14.8 | 73 | 5 | AA |
| Example 4 | B | 5.2 | 73 | 5 | AA |
| Example 5 | B | 4.8 | 73 | 5 | A |
| Example 6 | C | 15.2 | 110 | 4 | A |
| Example 7 | C | 14.8 | 110 | 5 | AA |
| Example 8 | C | 5.2 | 110 | 5 | AA |
| Example 9 | C | 4.8 | 110 | 5 | A |
| Example 10 | D | 14.8 | 67 | 5 | A |
| Example 11 | D | 5.2 | 67 | 5 | A |
| Example 12 | E | 14.8 | 125 | 5 | A |
| Example 13 | E | 5.2 | 125 | 5 | A |
| Example 14 | F | 20.2 | 53 | 3 | B |
| Example 15 | F | 19.8 | 53 | 4 | A |
| Example 16 | F | 4.2 | 53 | 5 | A |
| Example 17 | F | 3.8 | 53 | 5 | B |
| Example 18 | G | 20.2 | 184 | 3 | B |
| Example 19 | G | 19.8 | 184 | 4 | A |
| Example 20 | G | 4.2 | 184 | 5 | A |
| Example 21 | G | 3.8 | 184 | 5 | B |
| Example 22 | H | 19.8 | 47 | 4 | B |
| Example 23 | H | 4.2 | 47 | 5 | B |
| Example 24 | I | 19.8 | 210 | 4 | B |
| Example 25 | I | 4.2 | 210 | 5 | B |
| Example 26 | J | 33 | 32 | 2 | C |
| Example 27 | J | 31 | 32 | 3 | B |
| Example 28 | J | 3.2 | 32 | 5 | B |
| Example 29 | J | 2.8 | 32 | 5 | C |
| Example 30 | K | 33 | 285 | 2 | C |
| Example 31 | K | 31 | 285 | 3 | B |
| Example 32 | K | 3.2 | 285 | 5 | B |
| Example 33 | K | 2.8 | 285 | 5 | C |
| Example 34 | L | 31 | 29 | 3 | C |
| Example 35 | L | 3.2 | 29 | 5 | C |
| Example 36 | M | 31 | 315 | 3 | C |

TABLE 1-continued

| | Type of resin particle dispersion | Content of specific resin particles in toner particle [% by weight] | Number-average particle diameter of specific resin particles in toner particle [nm] | Evaluation | |
|---|---|---|---|---|---|
| | | | | Brilliance | Fogging |
| Example 37 | M | 3.2 | 315 | 5 | C |
| Example 38 | N | 11 | 101 | 5 | A |
| Example 39 | O | 11 | 110 | 5 | A |
| Example 40 | P | 11 | 100 | 5 | A |
| Example 41 | Q | 11 | 105 | 5 | C |
| Comparative Example 1 | — | 0 | — | 5 | D |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charge image developing toner comprising:

toner particles containing a binder resin containing a polyester resin;

particles of at least one selected from a styrene-(meth) acrylic resin particle and an acrylic resin particle; and a brilliant pigment, wherein the toner particles have a sea-island structure in which the binder resin represents a sea portion and the particles of at least one selected from a styrene-(meth) acrylic resin particle and an acrylic resin particle represents an island portion, and the particles of at least one selected from the styrene-(meth)acrylic resin particle and the acrylic resin particle are aggregated with the brilliant pigment such that the particles of the at least one selected from a styrene-(meth)acrylic resin particle and an acrylic resin particle are unevenly distributed around the brilliant pigment.

2. The electrostatic charge image developing toner according to claim 1, wherein a content of the particles of at least one selected from the styrene-(meth) acrylic resin particle and the acrylic resin particle is from 3% by weight to 32% by weight with respect to the toner.

3. The electrostatic charge image developing toner according to claim 1, wherein a number-average particle diameter of the particles of at least one selected from the styrene-(meth) acrylic resin particles and the acrylic resin particles is from 30 nm to 300 nm.

4. The electrostatic charge image developing toner according to claim 1, wherein the brilliant pigment contains aluminum.

5. The electrostatic charge image developing toner according to claim 1, wherein a content of the brilliant pigment is from 1% by weight to 50% by weight with respect to the toner.

6. The electrostatic charge image developing toner according to claim 1, wherein a volume average particle diameter of the toner is from 5 μm to 20 μm.

7. The electrostatic charge image developing toner according to claim 1, wherein the toner particles are flake shape particles.

8. The electrostatic charge image developing toner according to claim 1, wherein a weight ratio of the particles of at least one selected from the styrene-(meth)acrylic resin particle and the acrylic resin particle and the brilliant pigment is in a range of 3:1 to 3:50.

9. An electrostatic charge image developer comprising the electrostatic charge image developing toner according to claim 1.

10. A toner cartridge that accommodates the electrostatic charge image developing toner according to claim 1, and is detachable from an image forming apparatus.

11. A process cartridge comprising:

a developing unit that accommodates the electrostatic charge image developer according to claim 9, and develops an electrostatic charge image formed on a surface of an image holding member as a toner image with the electrostatic charge image developer, wherein the process cartridge is detachable from an image forming apparatus.

* * * * *